US009215540B2

(12) United States Patent
Tsai et al.

(10) Patent No.: US 9,215,540 B2
(45) Date of Patent: Dec. 15, 2015

(54) BUZZ DETECTING METHOD AND SYSTEM

(71) Applicant: Primax Electronics Ltd., Neihu, Taipei (TW)

(72) Inventors: Jung-Lang Tsai, Taipei (TW); Yuan Min Wang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 85 days.

(21) Appl. No.: 14/252,069

(22) Filed: Apr. 14, 2014

(65) Prior Publication Data

US 2015/0215717 A1 Jul. 30, 2015

(30) Foreign Application Priority Data

Jan. 28, 2014 (CN) ..... 2014 1 0041842

(51) Int. Cl.
*H04R 29/00* (2006.01)

(52) U.S. Cl.
CPC ..... *H04R 29/00* (2013.01)

(58) Field of Classification Search
CPC ..... H04R 29/00
See application file for complete search history.

(56) References Cited

U.S. PATENT DOCUMENTS

2012/0106750 A1* 5/2012 Thormundsson ..... H04R 3/007 381/71.12
2013/0129097 A1* 5/2013 Park ..... G01L 25/69 381/56

* cited by examiner

*Primary Examiner* — Sonia Gay
(74) *Attorney, Agent, or Firm* — Kirton McConkie; Evan R. Witt

(57) ABSTRACT

A buzz detecting method and a buzz detecting system are provided for testing whether an under-test sound playing device generates a buzz while playing sound. By an application program module, plural under-test sound signals from the under-test sound playing device are converted into plural under-test frequency-domain signals corresponding to the under-test sound signals through Fourier transform. Moreover, the application program module calculates plural under-test noise ratios corresponding to the frequencies of respective under-test sound signals according to respective under-test frequency-domain signals. After the plural under-test noise ratios are compared with plural standard noise ratios from a standard sound playing device, the application program module may automatically judge whether the under-test sound playing device generates a buzz while playing sound. Since the testing procedure does not need to be implemented by the trained testers, the overall efficiency is largely enhanced.

12 Claims, 9 Drawing Sheets

BUZZ DETECTING METHOD AND SYSTEM

FIELD OF THE INVENTION

The present invention relates to a buzz detecting method and a buzz detecting system, and more particularly to a buzz detecting method and a buzz detecting system for using an instrument to read and analyze an under-test sound signal from an under-test sound playing device and judge whether the under-test sound playing device generates a buzz while playing sound.

BACKGROUND OF THE INVENTION

Nowadays, audio and video products are gradually used in homes. Consequently, the market demands on sound playing devices (e.g. single speakers or stereo devices) are growing. For maintaining the quality of the sound playing devices, after the sound playing devices are produced at the production side, it is necessary to test the sound playing devices. After the testing procedure is done, the manufacturer may assure that no buzz is generated while the sound playing devices play sound.

In accordance with a conventional testing method, after the signals with different frequencies are continuously transmitted to the sound playing device, the tester judges whether the sound outputted from the sound playing device contains a buzz by manually hearing the signals with ears. Consequently, the quality of the sound playing device may be discriminated.

However, the testing procedure has to be implemented by the trained testers. Since the experiences and the body conditions of different testers are distinguished, the judgment about the testing result is very subjective and lacks of consistence. Moreover, after the hearing system of the tester has been intensively stimulated for a long time, the hearing system is possibly hurt.

For overcoming the above drawbacks and increasing the testing efficiency, there is a need of providing an automatic testing method and an automatic testing system to use an instrument to perform the testing procedure in replace of the human hearing system.

SUMMARY OF THE INVENTION

An object of the present invention provides an automatic buzz detecting method and an automatic buzz detecting system for a sound playing device in order to increase the testing efficiency.

In accordance with an aspect of the present invention, there is provided a buzz detecting method for testing whether an under-test sound playing device generates a buzz while playing sound. The buzz detecting method includes the following steps. Firstly, an audio processing device outputs plural baseband signals to the under-test sound playing device, so that plural under-test sound signals corresponding to the plural baseband signals are outputted from the under-test sound playing device. The plural baseband signals have different frequencies, and frequencies of the plural under-test sound signals are identical to corresponding frequencies of respective baseband signals. Then, a sound receiving device receives the plural under-test sound signals and transmits the plural under-test sound signals to the audio processing device. Then, an application program module converts the plural under-test sound signals into plural under-test frequency-domain signals corresponding to the plural under-test sound signals through Fourier transform. Then, the application program module calculates plural under-test noise ratios corresponding to the frequencies of respective under-test sound signals according to respective under-test frequency-domain signals. After the plural under-test noise ratios are compared with plural standard noise ratios of a standard sound playing device, the tester may judge whether the under-test sound playing device generates the buzz while playing sound. The standard sound playing device generates plural standard sound signals with plural frequencies corresponding to respective standard noise ratios. If the under-test noise ratio corresponding to any frequency of the plural under-test sound signals is higher than the standard noise ratio corresponding to the frequency by a specified ratio, it is determined that the under-test sound playing device generates the buzz while playing sound.

In accordance with another aspect of the present invention, there is provided a buzz detecting system for testing whether an under-test sound playing device generates a buzz while playing sound. The buzz detecting system includes an audio processing device, a processing unit, the under-test sound playing device, and a sound receiving device. The audio processing device outputs plural baseband signals, wherein the plural baseband signals have different frequencies. The processing unit is connected with the audio processing device, and includes an application program module and a storage unit. Moreover, plural standard noise ratios of a standard sound playing device are previously stored in the storage unit, wherein the standard sound playing device generates plural standard sound signals with plural frequencies corresponding to respective standard noise ratios. The under-test sound playing device is connected with the audio processing device, and receiving the plural baseband signals, so that plural under-test sound signals corresponding to the plural baseband signals are outputted from the under-test sound playing device. Moreover, the frequencies of the plural under-test sound signals are identical to corresponding frequencies of the respective baseband signals. The sound receiving device is connected with the audio processing device, and receives the plural under-test sound signals and transmits the plural under-test sound signals to the audio processing device. After the plural under-test sound signals are received by the audio processing device, the application program module converts the plural under-test sound signals into plural under-test frequency-domain signals corresponding to the plural under-test sound signals through Fourier transform, and the application program module calculates plural under-test noise ratios corresponding to the frequencies of respective under-test sound signals according to respective under-test frequency-domain signals. If the under-test noise ratio corresponding to any frequency of the plural under-test sound signals is higher than the standard noise ratio corresponding to the frequency by a specified ratio, it is determined that the under-test sound playing device generates the buzz while playing sound.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a buzz detecting method and a buzz detecting system for a sound playing device. In comparison with the conventional technology, the testing procedure is not necessarily implemented by the trained testers. In other words, the buzz detecting method and the buzz detecting system for the sound playing device according to the present invention may be automatically performed in order to detect the quality of the sound playing device.

Figure 1:
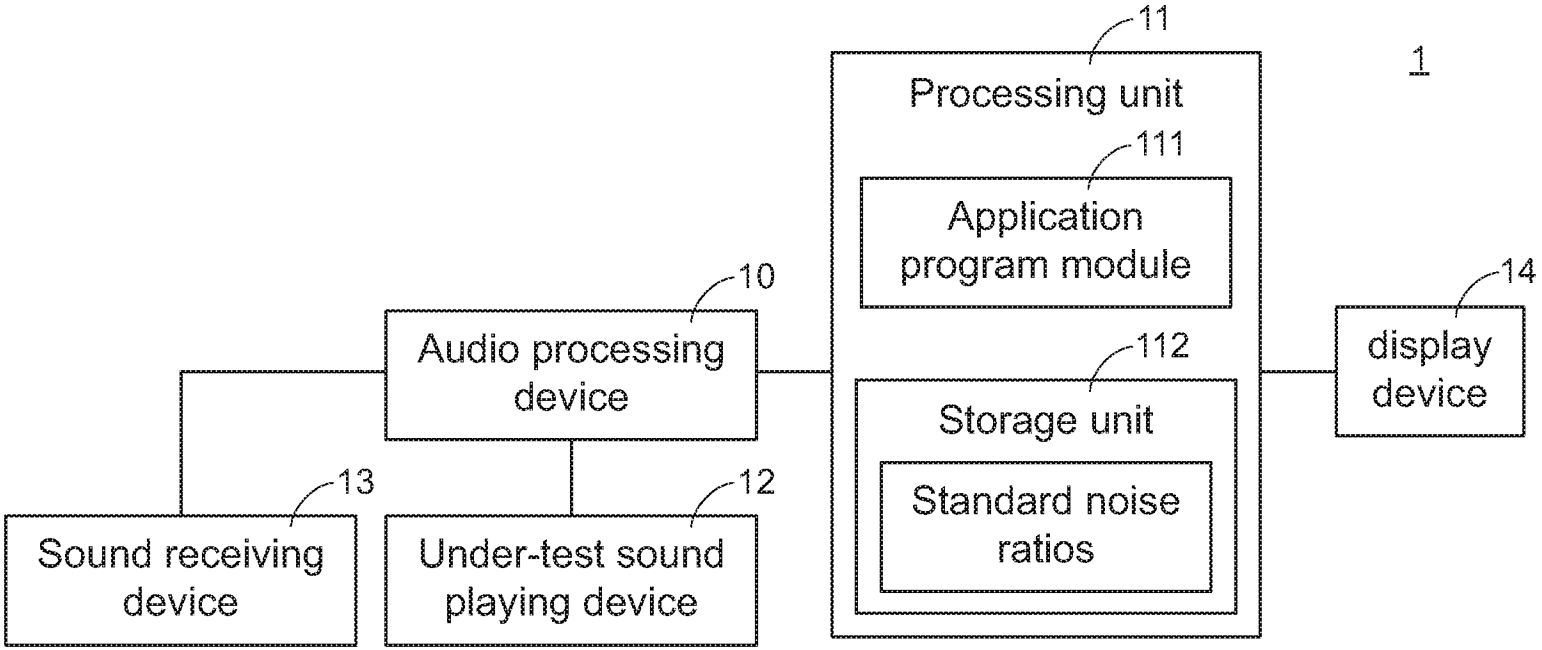
FIG. 1 is a schematic functional block diagram illustrating a buzz detecting system according to an embodiment of the present invention.

FIG. 1 is a schematic functional block diagram illustrating a buzz detecting system according to an embodiment of the present invention. As shown in FIG. 1, the buzz detecting system 1 comprises an audio processing device 10, a processing unit 11, an under-test sound playing device 12, a sound receiving device 13, and a display device 14.

The audio processing device 10 is a sound card or a dynamic signal acquisition (DSA) card. The processing unit 11 is connected with the audio processing device 10. In this embodiment, the processing unit 11 comprises an application program module 111 and a storage unit 112. Moreover, the audio processing device 10 and the processing unit 11 are connected with the same electronic device (not shown). An example of the electronic device includes but is not limited to a desktop computer or a notebook computer.

The under-test sound playing device 12 is a single speaker or a stereo device that undergoes a quality testing procedure. The under-test sound playing device 12 is connected with the audio processing device 10. An example of the sound receiving device 13 is a microphone. Moreover, the sound receiving device 13 is also connected with the audio processing device 10. An example of the display device 14 includes but is not limited to a computer monitor. Moreover, the display device 14 is connected with the processing unit 11.

Figure 2:
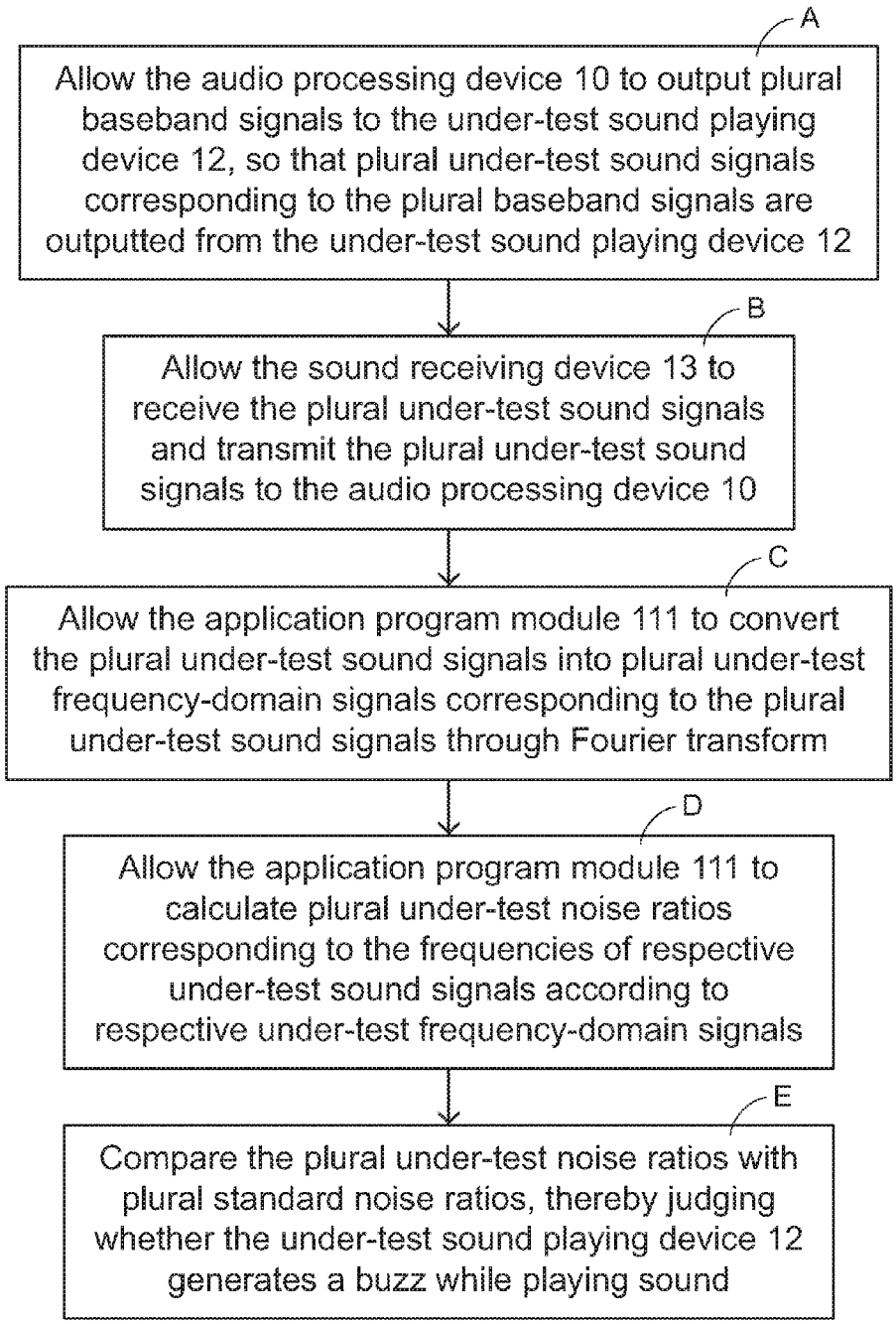
FIG. 2 is a flowchart illustrating a buzz detecting procedure of a buzz detecting method according to an embodiment of the present invention.

FIG. 2 is a flowchart illustrating a buzz detecting procedure of a buzz detecting method according to an embodiment of the present invention. In accordance with the present invention, a standard sound playing device that has passed the test and the under-test sound playing device 12 receive the same signals and execute the sound playing actions. By comparing the sound playing contents of the standard sound playing device with the sound playing contents of the under-test sound playing device 12, the tester may judge whether the sound playing quality of the under-test sound playing device 12 reaches the sound playing quality of the standard sound playing device. Consequently, before the process of testing the under-test sound playing device 12, plural noise ratios (also referred as standard noise ratios) corresponding to the frequencies of all standard sound signals from the standard sound playing device are previously stored in the storage unit 112 of the processing unit 11. Hereinafter, the procedure of testing the under-test sound playing device 12 will be illustrated at first, and the procedure of acquiring the plural standard noise ratios will be illustrated later.

The method of testing the under-test sound playing device 12 according to the preset invention comprises the following steps.

In a step A, the audio processing device 10 outputs plural baseband signals to the under-test sound playing device 12, so that plural under-test sound signals corresponding to the plural baseband signals are outputted from the under-test sound playing device 12.

In a step B, the sound receiving device 13 receives the plural under-test sound signals and transmits the plural under-test sound signals to the audio processing device 10.

In a step C, the application program module 111 converts the plural under-test sound signals into plural under-test frequency-domain signals corresponding to the plural under-test sound signals through Fourier transform.

In a step D, the application program module 111 calculates plural under-test noise ratios corresponding to the frequencies of respective under-test sound signals according to respective under-test frequency-domain signals.

In a step E, the plural under-test noise ratios are compared with plural standard noise ratios, thereby judging whether the under-test sound playing device 12 generates a buzz while playing sound.

Before the testing procedure is performed, the tester is unable to realize whether the under-test sound playing device 12 generates the buzz while playing sound, and the tester is unable to realize the occurrence frequency of the buzz. In the step A, plural under-test sound signals with plural frequencies are outputted to the under-test sound playing device 12. Consequently, the generation of buzzes in a wide frequency range can be detected.

Moreover, after each baseband signal is received by the under-test sound playing device 12, the corresponding sound signal (also referred as the under-test sound signal) is generated, the sound signal is converted into the corresponding frequency-domain signal, the under-test noise ratio corresponding to the frequency of the frequency-domain signal is calculated, and the noise ratio (also referred as the under-test noise ratio) of the under-test sound playing device 12 is compared with the corresponding standard noise ratio of the standard sound playing device. Consequently, the tester may judge whether the under-test sound playing device generates the buzz while playing sound and realize the occurrence frequency of the buzz. The operations of the buzz detecting method will be illustrated as follows.

Firstly, in the steps A, the audio processing device 10 continuously outputs the plural baseband signals to the under-test sound playing device 12, so that the plural under-test sound signals corresponding to the plural baseband signals are outputted from the under-test sound playing device 12. In this embodiment, the plural baseband signals are constituted by plural signals with different frequencies. The frequencies of each baseband signal are in the range between 50 Hz and 10000 Hz, but are not limited thereto. It is noted that the number of the baseband signals and the frequencies of the baseband signals are not restricted. Moreover, the difference between the frequencies of two consecutive baseband signals is not restricted. That is, the difference between the frequencies of two consecutive baseband signals may be determined according to the specifications of the sound playing device.

After the plural baseband signals are received by the under-test sound playing device 12, the plural under-test sound signals corresponding to the plural baseband signals are outputted from the under-test sound playing device 12. For example, if the plural baseband signals contain the signals with frequencies 100 Hz, 160 Hz, 315 Hz and 500 Hz, the under-test sound signals outputted from the under-test sound playing device 12 contain the signals with frequencies 100 Hz, 160 Hz, 315 Hz and 500 Hz.

At the same time, the sound receiving device 13 beside the under-test sound playing device 12 receives the plural under-test sound signals and transmits the plural under-test sound signals to the audio processing device 10. That is, the step B is performed. In this embodiment, after the sound receiving device 13 receives the plural under-test sound signals, the sound receiving device 13 generates plural digital signals and transmits the plural digital signals to the audio processing device 10. Then, according to the plural digital signals, the processing unit 11 generates plural under-test frequency-domain signals corresponding to the plural under-test sound signals. That is, the step C is performed.

Figure 3:
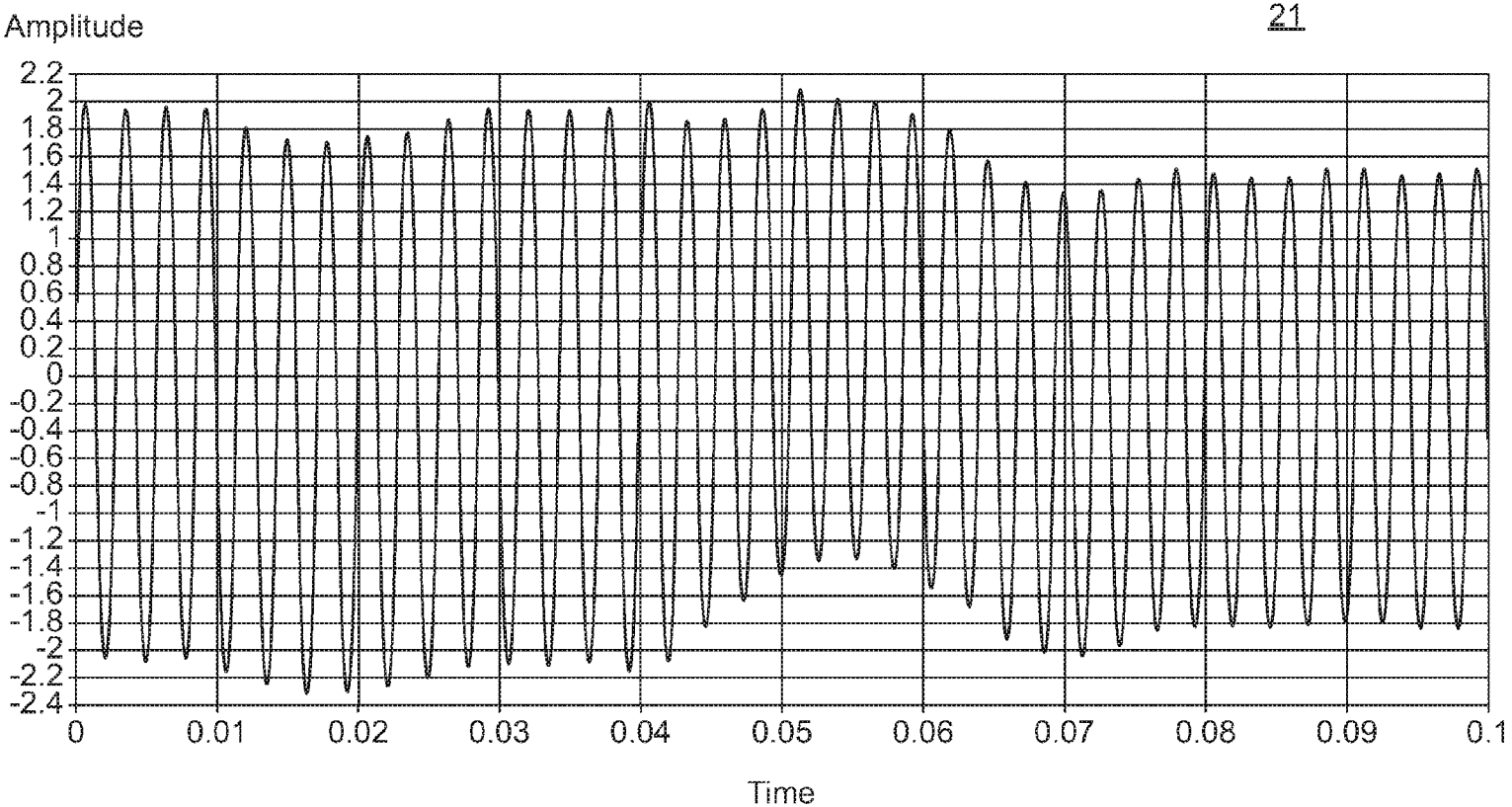
FIG. 3 is a schematic time-domain waveform diagram illustrating the under-test sound signals corresponding to one baseband signal.
Figure 4:
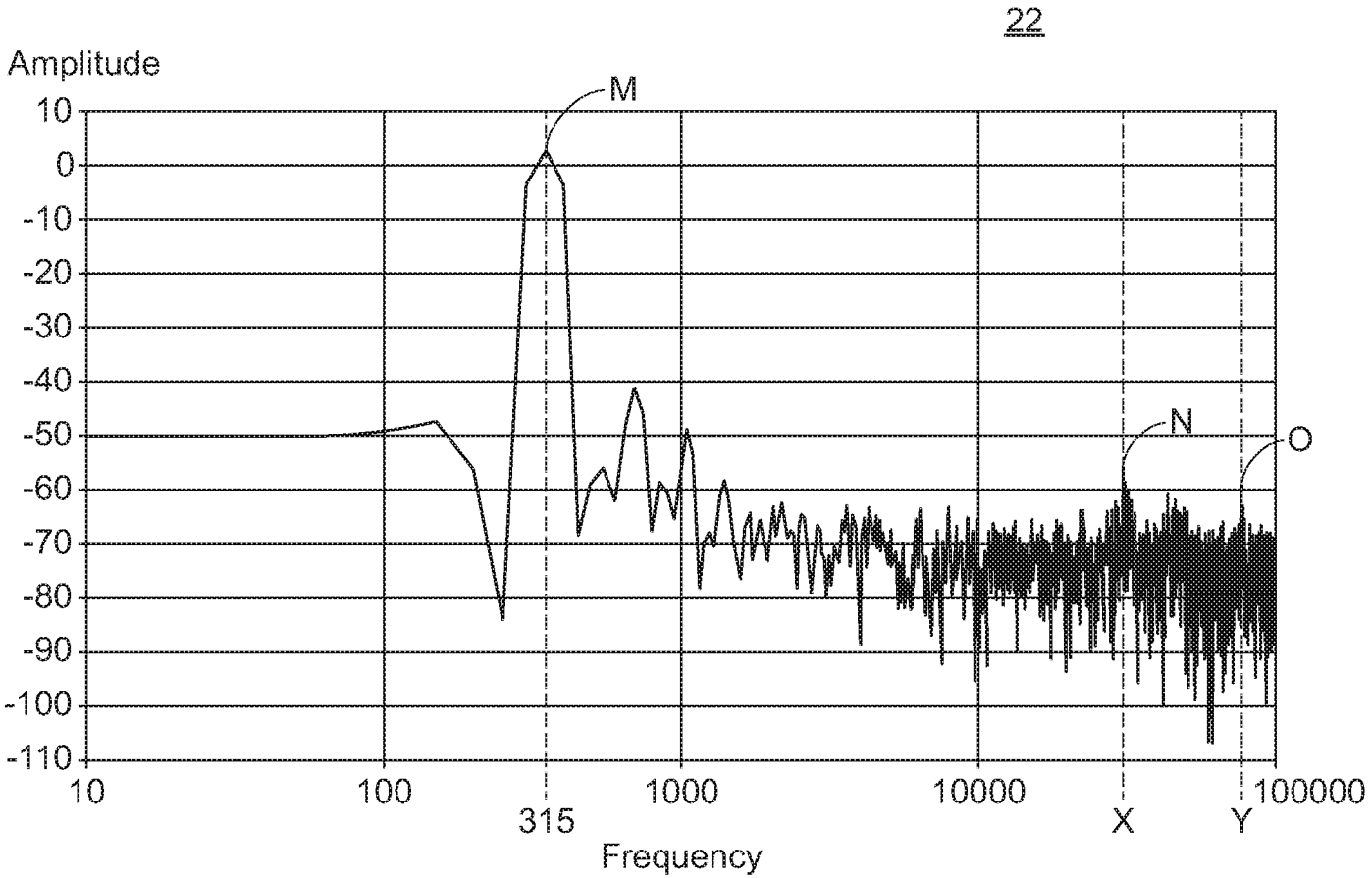
FIG. 4 is a schematic waveform diagram illustrating the under-test frequency-domain signal corresponding to the under-test sound signal of FIG. 3.
Figure 5:
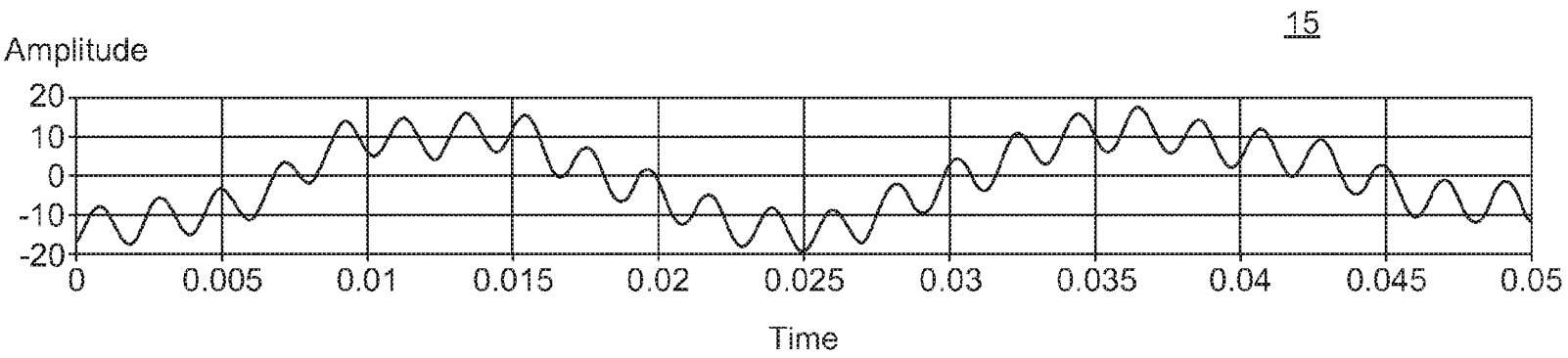
FIG. 5 is a schematic time-domain waveform diagram illustrating the under-test sound signals corresponding to another baseband signal.
Figure 6:
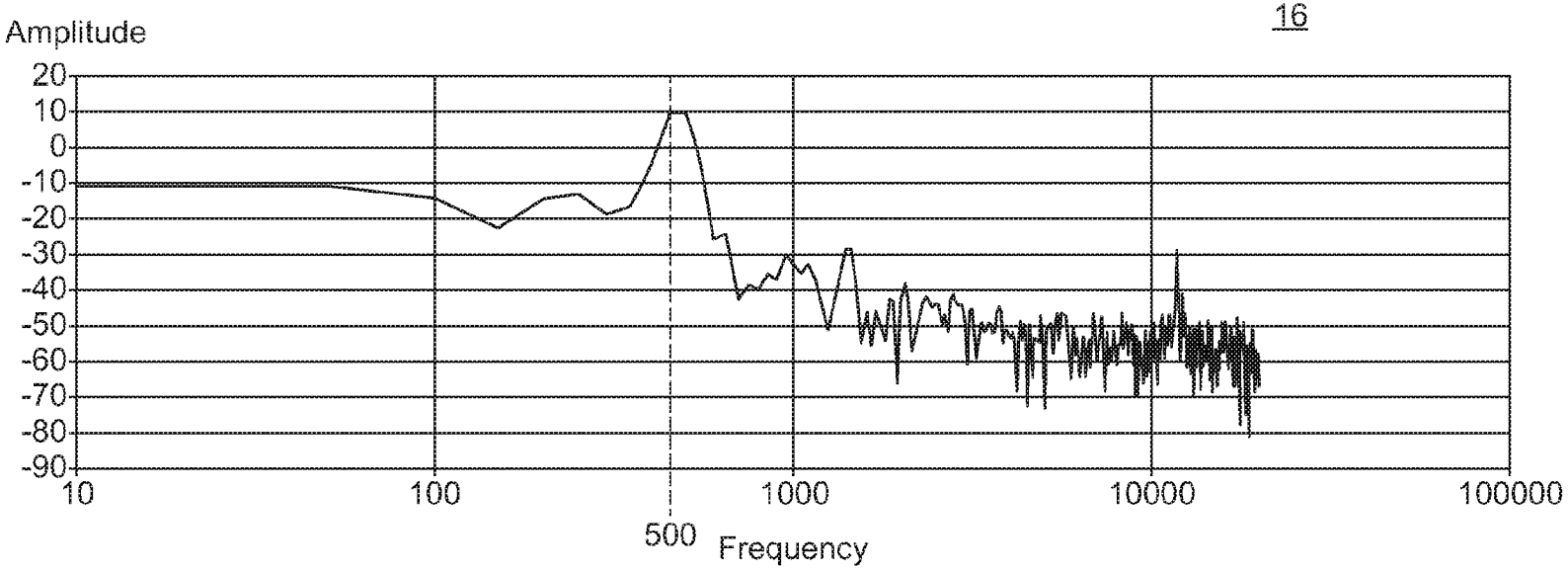
FIG. 6 is a schematic waveform diagram illustrating the under-test frequency-domain signal corresponding to the under-test sound signal of FIG. 5.

For brevity, the formation of the under-test frequency-domain signals corresponding to the under-test sound signals will be illustrated by referring to the under-test sound signals corresponding to two baseband signals with the frequencies 315 Hz and 500 Hz. Please refer to FIGS. 2-6. FIG. 3 is a schematic time-domain waveform diagram illustrating the under-test sound signals corresponding to one baseband signal. FIG. 4 is a schematic waveform diagram illustrating the under-test frequency-domain signal corresponding to the under-test sound signal of FIG. 3. FIG. 5 is a schematic time-domain waveform diagram illustrating the under-test sound signals corresponding to another baseband signal. FIG. 6 is a schematic waveform diagram illustrating the under-test frequency-domain signal corresponding to the under-test sound signal of FIG. 5.

Firstly, a digital signal is generated according to the under-test sound signal corresponding to the baseband signal with the frequency 315 Hz, and the digital signal is received by the audio processing device 10. Consequently, the audio processing device 10 generates a time-domain waveform 21 with the frequency 315 Hz and transmits the time-domain waveform 21 to the application program module 111 of the processing unit 11. As shown in FIG. 3, the horizontal axis of the time-domain waveform 21 denotes time, and the vertical axis of the time-domain waveform 21 denotes amplitude. For brevity, only a portion of the time-domain waveform 21 is shown in FIG. 3. Then, by the application program module 111, the time-domain waveform 21 corresponding to the under-test sound signal corresponding to the baseband signal with the frequency 315 Hz is converted into a corresponding frequency-domain signal 22 (also referred as an under-test frequency-domain signal) through Fourier transform. As shown in FIG. 4, the horizontal axis of the under-test frequency-domain signal 22 denotes frequency, and the vertical axis of the under-test frequency-domain signal 22 denotes amplitude.

Similarly, another digital signal is generated according to the under-test sound signal corresponding to the baseband signal with the frequency 500 Hz, and the digital signal is received by the audio processing device 10. Consequently, the audio processing device 10 generates a time-domain waveform 15 with the frequency 500 Hz and transmits the time-domain waveform 15 to the application program module 111 of the processing unit 11. As shown in FIG. 5, the horizontal axis of the time-domain waveform 15 denotes time, and the vertical axis of the time-domain waveform 15 denotes amplitude. For brevity, only a portion of the time-domain waveform 15 is shown in FIG. 5. Then, by the application program module 111, the time-domain waveform 15 corresponding to the under-test sound signal corresponding to the baseband signal with the frequency 500 Hz is converted into a corresponding frequency-domain signal 16 (also referred as an under-test frequency-domain signal) through Fourier transform. As shown in FIG. 6, the horizontal axis of the under-test frequency-domain signal 16 denotes frequency, and the vertical axis of the under-test frequency-domain signal 16 denotes amplitude.

After the plural under-test frequency-domain signals are acquired, the application program module 111 implements the step D. That is, plural under-test noise ratios corresponding to the frequencies of respective under-test sound signals are calculated according to respective under-test frequency-domain signals.

As shown in FIG. 4, the amplitude intensity (also referred as a sound intensity) of the under-test frequency-domain signal 22 has a peak value M at the frequency 315 Hz, and the peak values of the amplitude intensities of the under-test frequency-domain signal 22 at other frequencies are lower than the peak value M. That is, when the under-test sound playing device 12 generates the under-test sound signal with the frequency 315 Hz, the response at other frequencies cause distortion. Generally, if the altitude of the peak value gradually decreases with the increasing frequency and the sense of hearing is not interfered, it means that no buzz is detected.

In the under-test frequency-domain signal 22 as shown in FIG. 4, the amplitude intensity of the peak value N corresponding to the frequency X and the amplitude intensity of the peak value O corresponding to the frequency Y are higher than the amplitude intensities of the peak values corresponding to other frequencies that are smaller than the frequency X. That is, the amplitude intensities of the plural peak values of the under-test frequency-domain signal 22 do not decrease with the increasing frequency. Consequently, the tester may roughly judge that a serious distortion phenomenon is possibly generated when the under-test sound signal with the frequency 315 Hz and corresponding to the under-test frequency-domain signal 22 is played by the under-test sound playing device 12.

However, it is unable to confirm whether a buzz interfering with the hearing sense is generated when the under-test sound signal with the frequency 315 Hz is played by the under-test sound playing device 12 according to FIG. 4. In accordance with the present invention, an under-test noise ratio (i.e. a distortion factor) corresponding to the under-test sound signal with the frequency 315 Hz as shown in FIG. 4 should be firstly calculated, and then the under-test noise ratio is compared with a standard noise ratio corresponding to the 315 Hz-sound signal (also referred as a standard sound signal) from the standard sound playing device. According to the comparing result, the tester may judge whether the under-test sound signal with the frequency 315 Hz as shown in FIG. 4 is suffered from serious distortion and judge whether the buzz that interfering with the hearing sense is generated.

In FIG. 4, the under-test noise ratio corresponding to the frequency 315 Hz of the under-test sound signal is calculated by the following formula according to the plural sound intensity levels (also referred as amplitude intensity levels) corresponding to plural integral multiples of the frequency 315 Hz of the under-test frequency-domain signal 22. The formula is expressed as follow:

$$\frac{\sqrt{H_P^2 + H_{P+1}^2 + \ldots + H_{Q-1}^2 + H_Q^2}}{\sqrt{H_1^2 + H_2^2 + H_3^2 + \ldots + H_Q^2}} \times 100,$$

where, P and Q are both positive integers, and P is larger than 1 and smaller than Q.

In the above formula, $H_1$ indicates the sound intensity level of the under-test frequency-domain signal 22 corresponding to a fundamental frequency of the under-test sound signal (i.e. the sound intensity level corresponding to the frequency 315 Hz); $H_2$ indicates the sound intensity level of the under-test frequency-domain signal 22 corresponding to two multiples of the fundamental frequency of the under-test sound signal (i.e. the sound intensity level corresponding to the frequency 630 Hz); and the rest may be deduced by analogy. In an embodiment, P is 8, and Q is 50. It is noted that the values of P and Q may be varied according to the characteristics of the sound playing devices.

Similarly, in FIG. 6, the under-test noise ratio corresponding to the frequency 500 Hz of the under-test sound signal is calculated by the above formula according to the plural sound intensity levels corresponding to plural integral multiples of the frequency 500 Hz of the under-test frequency-domain signal 16. The way of calculating the under-test noise ratio corresponding to the frequency 500 Hz of the under-test sound signal is not redundantly described herein.

After the above procedures are repeatedly done, the plural under-test noise ratios corresponding to the frequencies of respective under-test sound signals are calculated according to respective under-test frequency-domain signals. That is, the step D is completed.

Figure 7:
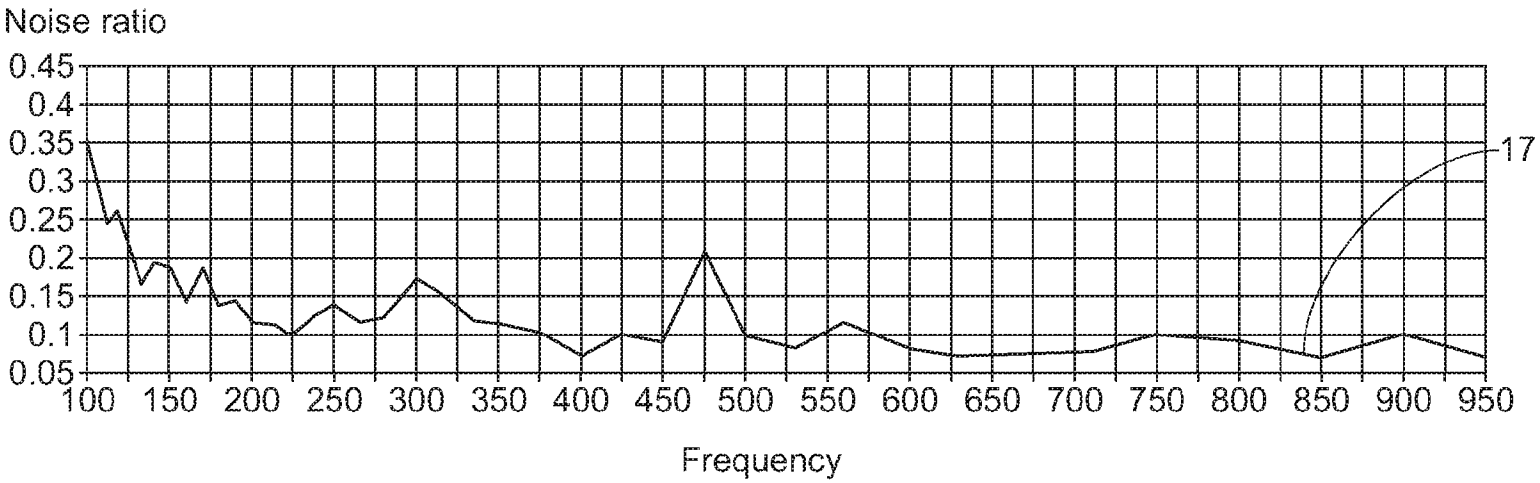
FIG. 7 schematically illustrates a first frequency-noise ratio curve obtained by the buzz detecting method and the buzz detecting system of the present invention.

FIG. 7 schematically illustrates a first frequency-noise ratio curve obtained by the buzz detecting method and the buzz detecting system of the present invention. After the above procedures are completed, the plural under-test noise ratios corresponding to the frequencies of respective under-test sound signals are obtained. Consequently, the relationships between the plural under-test noise ratios and the frequencies may be plotted as the first frequency-noise ratio curve 17 of FIG. 7. As shown in FIG. 7, the horizontal axis of the first frequency-noise ratio curve 17 denotes frequency, and the vertical axis of the first frequency-noise ratio curve 17 denotes the noise ratio. The frequency as shown in FIG. 7 is in the range between 100 Hz and 950 Hz. It is noted that the range of the frequency is not restricted. That is, the range of the frequency may be determined according to the specifications of the sound playing device.

Figure 8:
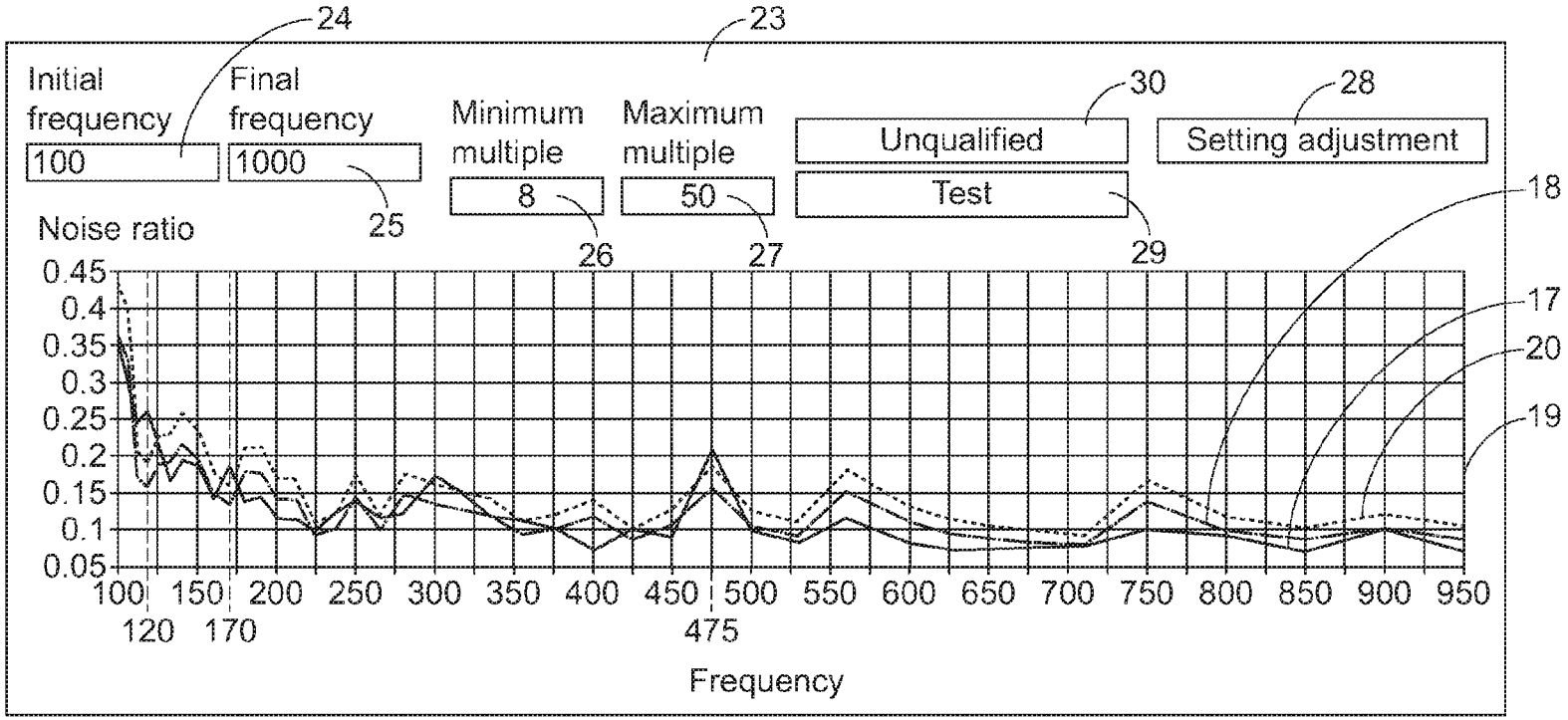
FIG. 8 schematically illustrates the comparison between the first frequency-noise ratio curve and a second frequency-noise ratio curve and an operation interface by the buzz detecting method and the buzz detecting system of the present invention.

FIG. 8 schematically illustrates the comparison between the plural under-test noise ratios and the plural standard noise ratios and an operation interface by the buzz detecting method and the buzz detecting system of the present invention. Please refer to FIGS. 7 and 8. After the plural standard noise ratios corresponding to the frequencies of the plural standard sound signals from the standard sound playing device are acquired, the relationships between the plural standard noise ratios and the frequencies may be plotted as a second frequency-noise ratio curve 18 of FIG. 8. For facilitating comparison, the first frequency-noise ratio curve 17 and the second frequency-noise ratio curve 18 are included in the same plot, i.e. a comparison plot 19. As shown in FIG. 8, the horizontal axis of the comparison plot 19 denotes frequency, and the vertical axis of the comparison plot 19 denotes the noise ratio.

When the comparison plot 19 is shown on the display device 14, the tester may finely tune the comparison plot 19 through the operation interface 23 of FIG. 8. For example, the tester may input an initial frequency and a final frequency into an initial frequency field 24 and a final frequency field 25, respectively, in order to define a specified frequency range. Consequently, the noise ratios corresponding to the specified frequency range of the sound signals may be shown on the comparison plot 19. Moreover, the tester may input a value into a minimum multiple field 26 in order to modify the value P in the step D, and the tester may input a value into a maximum multiple field 27 in order to modify the value Q in the step D.

Moreover, after a setting adjustment item 28 is clicked, the tester may designate a specified ratio. According to the specified ratio, an upper limit curve 20 is defined. The upper limit curve 20 indicates the maximum allowable under-test noise ratios of the first frequency-noise ratio curve 17 at plural frequencies that exceed the standard noise ratios of the second frequency-noise ratio curve 18 at the corresponding frequencies. For example, the specified ratio designated by the tester is 15%. In case that the standard noise ratio of the second frequency-noise ratio curve 18 at a frequency is 0.35, the noise ratio of the upper limit curve 20 at this frequency is 0.4025. That is, the maximum allowable under-test noise ratio of the first frequency-noise ratio curve 17 at this frequency is 0.4025.

If the under-test noise ratio of the first frequency-noise ratio curve 17 at a frequency does not exceed the upper limit curve 20, the tester may judge that the sound signal with this frequency is not suffered from serious distortion and no buzz interfering with the hearing sense is generated while the sound signal is played by the under-test sound playing device 12. Consequently, after the plural under-test noise ratios are compared with the upper limit curve 20 defined by the plural standard noise ratios, the tester may judge whether the under-test sound playing device 12 generates the buzz while playing sound and realize the occurrence frequency of the buzz. That is, the step E is performed. Since the first frequency-noise ratio curve 17 about the plural under-test noise ratios, the second frequency-noise ratio curve 18 about the plural standard noise ratios and the upper limit curve 20 are included in the same plot, the tester may directly examine the comparison plot 19 to analyze whether the under-test noise ratio of the first frequency-noise ratio curve 17 at any frequency exceeds the upper limit curve 20, thereby judging whether the buzz interfering with the hearing sense is generated by the under-test sound playing device 12. It is noted that the step E may be performed by the application program module 111 after the test item 29 is clicked. The testing result may be shown in a testing result display zone 30. Moreover, when the step E is implemented by the application program module 111, the comparison plot 19 may be not shown. The contents of the operation interface 23 of FIG. 8 are presented herein for purpose of illustration and description only.

As shown in FIG. 8, all of the under-test noise ratios of the first frequency-noise ratio curve 17 at the frequencies 120 Hz, 170 Hz, 300 Hz and 475 Hz exceed the upper limit curve 20. Consequently, in this embodiment, the tester may judge that the under-test sound playing device 12 corresponding to the first frequency-noise ratio curve 17 is an unqualified product. The unqualified product generates a buzz interfering with the hearing sense while playing sound.

Figure 9:
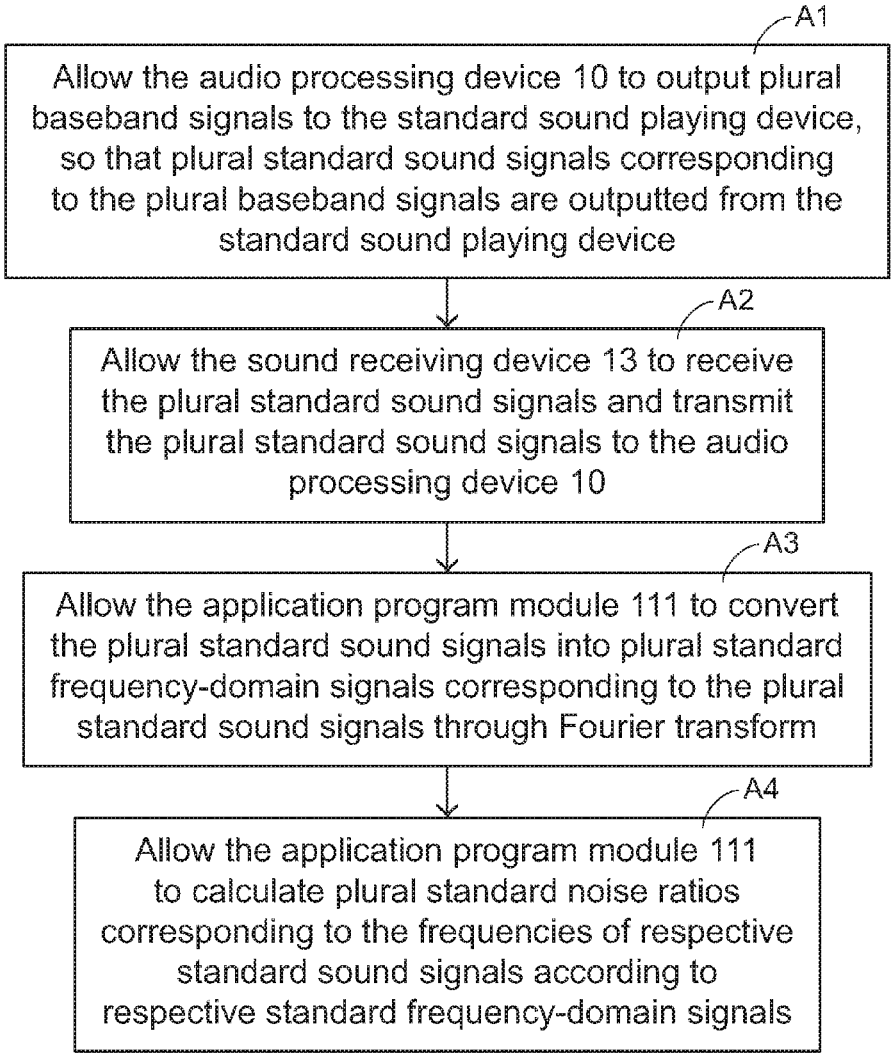
FIG. 9 is a flowchart illustrating a procedure of obtaining the second frequency-noise ratio curve according to an embodiment of the present invention.

Hereinafter, a procedure of acquiring plural standard noise ratios will be illustrated with reference to FIG. 9. FIG. 9 is a flowchart illustrating a procedure of acquiring plural standard noise ratios by the buzz detecting method and the buzz detecting system of the present invention. The procedure of acquiring the plural standard noise ratios comprises the following steps.

In a step A1, the audio processing device 10 outputs plural baseband signals to the standard sound playing device, so that plural standard sound signals corresponding to the plural baseband signals are outputted from the standard sound playing device.

In a step A2, the sound receiving device 13 receives the plural standard sound signals and transmits the plural standard sound signals to the audio processing device 10.

In a step A3, the application program module 111 converts the plural standard sound signals into plural standard frequency-domain signals corresponding to the plural standard sound signals through Fourier transform.

In a step A4, the application program module 111 calculates plural standard noise ratios corresponding to the frequencies of respective standard sound signals according to respective standard frequency-domain signals.

Except that the under-test sound playing device 12 is replaced by the standard sound playing device, the steps A1-A4 are substantially identical to the steps A-D, and are not redundantly described herein.

From the above descriptions, the present invention provides a buzz detecting method and a buzz detecting system. By the application program module 111, plural under-test sound signals are converted into plural under-test frequency-domain signals through Fourier transform. Moreover, the application program module 111 calculates plural under-test noise ratios corresponding to the frequencies of respective under-test sound signals according to respective under-test frequency-domain signals. After the plural under-test noise ratios are compared with plural standard noise ratios from the standard sound playing device, the application program module 111 may judge whether the under-test sound playing device 12 generates a buzz while playing sound. According to the buzz detecting method and the buzz detecting system of the present invention, the under-test sound signals are directly analyzed by the application program module 111. Since the testing procedure does not need to be implemented by the trained testers, the overall efficiency is largely enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A buzz detecting method for testing whether an under-test sound playing device generates a buzz while playing sound, the buzz detecting method comprising steps of:

(A) allowing an audio processing device to output plural baseband signals to the under-test sound playing device, so that plural under-test sound signals corresponding to the plural baseband signals are outputted from the under-test sound playing device, wherein the plural baseband signals have different frequencies, and frequencies of the plural under-test sound signals are identical to corresponding frequencies of respective baseband signals;

(B) allowing a sound receiving device to receive the plural under-test sound signals and transmit the plural under-test sound signals to the audio processing device;

(C) allowing an application program module to convert the plural under-test sound signals into plural under-test frequency-domain signals corresponding to the plural under-test sound signals through Fourier transform;

(D) allowing the application program module to calculate plural under-test noise ratios corresponding to the frequencies of respective under-test sound signals according to respective under-test frequency-domain signals; and (E) comparing the plural under-test noise ratios with plural standard noise ratios of a standard sound playing device, thereby judging whether the under-test sound playing device generates the buzz while playing sound, wherein the standard sound playing device generates plural standard sound signals with plural frequencies corresponding to respective standard noise ratios, wherein if the under-test noise ratio corresponding to any frequency of the plural under-test sound signals is higher than the standard noise ratio corresponding to the frequency by a specified ratio, it is determined that the under-test sound playing device generates the buzz while playing sound.

2. The buzz detecting method according to claim 1, wherein the frequencies of the plural baseband signals are in a range between 50 Hz and 10000 Hz.

3. The buzz detecting method according to claim 1, wherein in the step (D), each under-test noise ratio is calculated according to a formula:

$$\frac{\sqrt{H_P^2 + H_{P+1}^2 + \ldots + H_{Q-1}^2 + H_Q^2}}{\sqrt{H_1^2 + H_2^2 + H_3^2 + \ldots + H_Q^2}} \times 100,$$

wherein P and Q are both positive integers, and P is larger than 1 and smaller than Q, wherein $H_1 \sim H_Q$ indicate plural sound intensity levels corresponding to plural positive integral multiples of the frequency of each under-test sound signal corresponding to respective under-test frequency-domain signal.

4. The buzz detecting method according to claim 1, wherein before the step (A), the buzz detecting system further comprises steps:

(A1) allowing the audio processing device to output the plural baseband signals to the standard sound playing device, so that plural standard sound signals corresponding to the plural baseband signals are outputted from the standard sound playing device, wherein frequencies of the plural standard sound signals are identical to corresponding frequencies of respective baseband signals;

(A2) allowing the sound receiving device to receive the plural standard sound signals and transmit the plural standard sound signals to the audio processing device;

(A3) allowing the application program module to convert the plural standard sound signals into plural standard frequency-domain signals corresponding to the plural standard sound signals through Fourier transform; and (A4) allowing the application program module to calculate plural standard noise ratios corresponding to the frequencies of respective standard sound signals according to respective standard frequency-domain signals.

5. The buzz detecting method according to claim 4, wherein in the step (A4), each standard noise ratios is calculated according to a formula:

$$\frac{\sqrt{H_P^2 + H_{P+1}^2 + \ldots + H_{Q-1}^2 + H_Q^2}}{\sqrt{H_1^2 + H_2^2 + H_3^2 + \ldots + H_Q^2}} \times 100,$$

wherein P and Q are both positive integers, and P is larger than 1 and smaller than Q, wherein $H_1 \sim H_Q$ indicate plural sound intensity levels corresponding to plural positive integral multiples of the frequency of each standard sound signal corresponding to respective standard frequency-domain signal.

6. The buzz detecting method according to claim 1, wherein the audio processing device is a sound card or a dynamic signal acquisition (DSA) card, the under-test sound playing device is a single speaker or a stereo device, and the sound receiving device is a microphone.

7. A buzz detecting system for testing whether an under-test sound playing device generates a buzz while playing sound, the buzz detecting system comprising:

an audio processing device outputting plural baseband signals, wherein the plural baseband signals have different frequencies;

a processing unit connected with the audio processing device, and comprising an application program module and a storage unit, wherein plural standard noise ratios of a standard sound playing device are previously stored in the storage unit, wherein the standard sound playing device generates plural standard sound signals with plural frequencies corresponding to respective standard noise ratios;

the under-test sound playing device connected with the audio processing device, and receiving the plural baseband signals, so that plural under-test sound signals corresponding to the plural baseband signals are outputted from the under-test sound playing device, wherein frequencies of the plural under-test sound signals are identical to corresponding frequencies of the respective baseband signals; and a sound receiving device connected with the audio processing device, and receiving the plural under-test sound signals and transmitting the plural under-test sound signals to the audio processing device, wherein after the plural under-test sound signals are received by the audio processing device, the application program module converts the plural under-test sound signals into plural under-test frequency-domain signals corresponding to the plural under-test sound signals through Fourier transform, and the application program module calculates plural under-test noise ratios corresponding to the frequencies of respective under-test sound signals according to respective under-test frequency-domain signals, wherein if the under-test noise ratio corresponding to any frequency of the plural under-test sound signals is higher than the standard noise ratio corresponding to the frequency by a specified ratio, it is determined that the under-test sound playing device generates the buzz while playing sound.

8. The buzz detecting system according to claim 7, wherein the frequencies of the plural baseband signals are in a range between 50 Hz and 10000 Hz.

9. The buzz detecting system according to claim 7, wherein each under-test noise ratio is calculated according to a formula:

$$\frac{\sqrt{H_P^2 + H_{P+1}^2 + \ldots + H_{Q-1}^2 + H_Q^2}}{\sqrt{H_1^2 + H_2^2 + H_3^2 + \ldots + H_Q^2}} \times 100,$$

wherein P and Q are both positive integers, and P is larger than 1 and smaller than Q, wherein $H_1 \sim H_Q$ indicate plural sound intensity levels corresponding to plural positive integral multiples of the frequency of each under-test sound signal corresponding to respective under-test frequency-domain signal.

10. The buzz detecting system according to claim 7, wherein the audio processing device further outputs plural baseband signals to the standard sound playing device, so that plural standard sound signals corresponding to the plural baseband signals are outputted from the standard sound playing device, wherein frequencies of the plural standard sound signals are identical to corresponding frequencies of respective baseband signals, wherein the sound receiving device further receives the plural standard sound signals and transmits the plural standard sound signals to the audio processing device, wherein the application program module further converts the plural standard sound signals into plural standard frequency-domain signals corresponding to the plural standard sound signals through Fourier transform, and calculates plural standard noise ratios corresponding to the frequencies of respective standard sound signals according to respective standard frequency-domain signals.

11. The buzz detecting system according to claim 10, wherein each standard noise ratio is calculated according to a formula:

$$\frac{\sqrt{H_P^2 + H_{P+1}^2 + \ldots + H_{Q-1}^2 + H_Q^2}}{\sqrt{H_1^2 + H_2^2 + H_3^2 + \ldots + H_Q^2}} \times 100,$$

wherein P and Q are both positive integers, and P is larger than 1 and smaller than Q, wherein $H_1 \sim H_Q$ indicate plural sound intensity levels corresponding to plural positive integral multiples of the frequency of each standard sound signal corresponding to respective standard frequency-domain signal.

12. The buzz detecting system according to claim 7, wherein the audio processing device is a sound card or a dynamic signal acquisition (DSA) card, the under-test sound playing device is a single speaker or a stereo device, and the sound receiving device is a microphone.

* * * * *